US006869313B2

(12) United States Patent
Gibboney

(10) Patent No.: US 6,869,313 B2
(45) Date of Patent: Mar. 22, 2005

(54) FUSED RECEPTACLE WITH POWER CONVERSION/CONTROL BOARD

(75) Inventor: James W. Gibboney, Conyers, GA (US)

(73) Assignee: Ventur Research and Dev. Corp., Suwanee, GA (US)

( * ) Notice: Subject to any disclaimer, the term of this patent is extended or adjusted under 35 U.S.C. 154(b) by 0 days.

(21) Appl. No.: 10/373,242

(22) Filed: Feb. 24, 2003

(65) Prior Publication Data

US 2004/0166735 A1 Aug. 26, 2004

(51) Int. Cl.[7] ..... H01R 13/66
(52) U.S. Cl. ..... 439/620
(58) Field of Search ..... 439/620–622, 439/76.2; 362/226, 251, 95; 315/178, 185 R, 192, 193, 185 S

(56) References Cited

U.S. PATENT DOCUMENTS 3,968,355 A * 7/1976 Smallegan ..... 362/226
4,717,350 A * 1/1988 Lax ..... 439/620
5,371,441 A * 12/1994 Nilssen ..... 362/226
6,132,257 A * 10/2000 Wang et al. ..... 439/622
6,190,207 B1 * 2/2001 Wang ..... 439/622

* cited by examiner

*Primary Examiner*—P. Austin Bradley
*Assistant Examiner*—Felix O. Figueroa
(74) *Attorney, Agent, or Firm*—Nexsen Pruet Adams Kleemeier, LLC; Michael A. Mann

(57) ABSTRACT

An electrical receptacle for use in a string of holiday lighting that has a removable, replaceable, on-board power control board. The control board taps into normal alternating current delivered to the receptacle from a pair of wires running from an electrical plug and uses it to deliver electrical power through a fuse to a third wire that supplies current to a set of lights carried by the third wire as it runs from the receptacle back to the plug. The control board may also rectify the current to the third wire so that the lights operate on direct current rather than alternating current. However the receptacle delivers alternating current to subsequent load plugged into it. The control board is also capable, with suitable choices of components carried by it, of other modifications of the electrical current it delivers to the third wire.

20 Claims, 5 Drawing Sheets

FUSED RECEPTACLE WITH POWER CONVERSION/CONTROL BOARD

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable

BACKGROUND OF THE INVENTION

Households and businesses are supplied with 120-volt alternating current (AC) for use in providing electrical power to a number of devices, including small appliances and lighting. AC is typically supplied to a receptacle in a wall outlet. When the need for electrical power is located at a distance from the wall outlet, an extension cord may be used to deliver the power to where it is needed. One end of the cord plugs into the wall outlet receptacle, and the opposing end of the cord provides a receptacle for use in connecting the electrical load.

Not all electrical loads require AC. Some require direct current (DC). DC can be obtained from a wall outlet using a rectifier to rectify the AC. Many consumer electronic devices such as computers and cordless telephones use DC instead of AC.

The range of devices using AC or DC varies considerably and is growing. The number of devices that may be plugged into a wall outlet receptacle is limited. Various devices exist to increase the number of receptacles and in some cases a series of loads have their own receptacles.

For example, strings of holiday lights have a plug for the AC wall outlet at one end and a receptacle at the other end so that additional strings can be plugged into and thereby powered by the first string. This arrangement is not without its problems. The current that can be drawn by several strings put together can pose a hazard. Accodingly, many holiday light strings carry a fuse to limit current. However, when up to three strings are connected together the fuse used to limit current must still pass considerable current, perhaps six or seven amperes. Consequently, consumers who may use more than three strings to decorate have to use at least two receptacles and still run the risk of an electrical hazard.

Strings of holidays lights have been developed by the present inventor that operate on DC rather than AC. These strings have rectifiers in the plug or the first light socket that convert the incoming AC to DC and provide fuse protection for the circuit.

As the nature and variety of appliances and uses for electricity increases, so too does the desire to control use so that products are not damaged and good use is made of the electricity consumed. Also, there is greater interest in the measurement of electricity consumed. Thus, there is a need for a device that provides a convenient source of electrical current, including AC or DC, and potentially offers unprecedented control over the current being used.

SUMMARY OF THE INVENTION

The present invention is a device for delivering electrical current. In one embodiment, it is an extension cord with a receptacle on one end that allows control and monitoring of the electrical current it delivers to the device plugged into its receptacle. In another embodiment, it is a three-wire AC extension cord that provides electrical power to a first load while delivering AC to a second electrical load plugged into it. In a modification of this embodiment, the first load is a DC load such as a string of lights.

The present invention comprises a plug connected to a receptacle using three electrically conducting wires: a line wire, a neutral wire and a third wire that simply terminates in the plug without electrical contact there. The receptacle has an on-board power control device that is arranged electrically in parallel with the receptacle's contacts. The power control device delivers electrical power to a load attached to the neutral wire and the third wire. Depending on the configuration of the power control device, the electrical power can be AC or DC, can be fused, stepped down in voltage, or can be controlled in other ways.

A feature of the present invention is the on-board power control device. This device serves as a "mother board" for a wide range of applications without modification of the balance of the device. Furthermore, because it is easily replaceable and may have "daughter boards," can be used to adapt the present device for other uses.

Another feature of the present invention is the manner in which the power control device taps into the power of the line and neutral wires, or just the neutral wire, to provide the desired control to the third wire.

Still another feature of the present invention is the ability to provide a separate fuse for the third wire load. In the context of a holiday light string, the ability to fuse each string separately makes it possible to use more than three strings in sequence and to use fuses with smaller ratings for each string. This feature means each light string is safer.

These an other features and their advantages will be apparent to those skilled in the household electrical arts from a careful reading of the Detailed Description of Preferred Embodiments, accompanied by the following drawings.

BRIEF DESCRIPTION OF PREFERRED EMBODIMENTS

DETAILED DESCRIPTION OF PREFERRED EMBODIMENTS

The present invention is a device for use in delivering electrical current to one or more loads. One load may be powered directly by the device and, indeed, may be incorporated into the device. The other load is plugged into the device and is thus powered indirectly.

Figure 1:
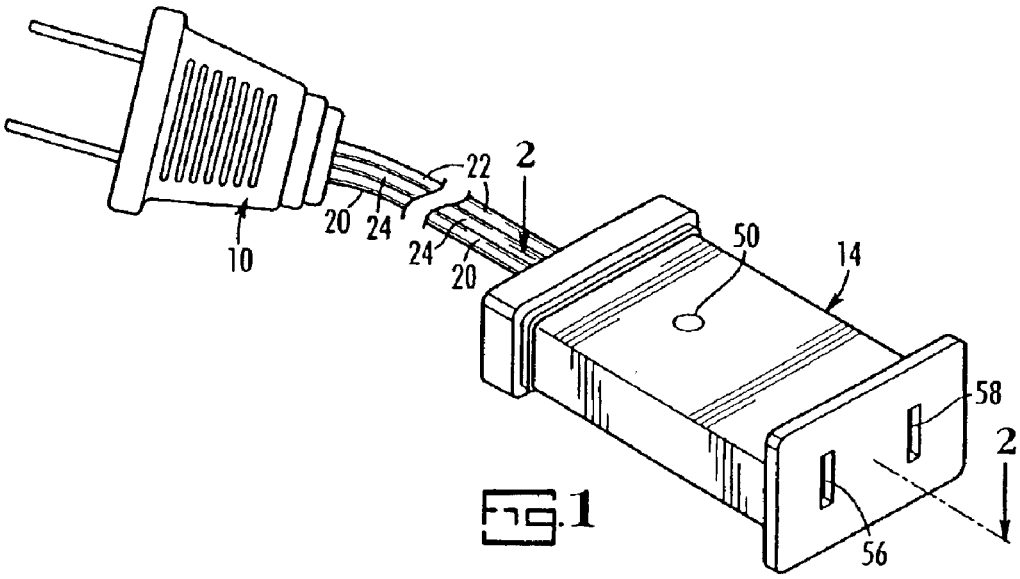
FIG. 1 is a perspective view of a receptacle according to a preferred embodiment of the present invention.

As shown in FIG. 1, the present device includes an electrical plug 10 connected to a receptacle 14 with three wires 20, 22, 24. Plug 10 is a conventional two-prong plug with two electrical contacts or prongs 32, 34, entending therefrom and adapted to plug into another electrical receptacle. The present plug's prong configuration can be adapted to accommodate receptacles standard in countries other than the US.

Wires 20, 22, 24, are all electrical conductors insulated from the environment and each other, and are preferably formed as a flat "ribbon." First wire 20 is a line conductor; second wire 22 is a neutral conductor; and third wire 24 supplies electrical current directly to a load, as will be described herein.

Receptacle 14 includes a housing 40 with a power section 44 and a fuse section 48. Power section 44 slides into fuse section 48, as shown, but with minor modification, fuse section 48 could be made to slide into power section 44. When power section 44 is fully seated in fuse section 48, the two are secured together with a locking screw 50. First, second and third wires 20, 22, 24, enter housing 40 through power section 44; two holes 56, 58, formed in fuse section 48 are dimensioned for receiving the prongs 62 of a plug 64 from an electrical appliance or other electrical load.

As shown in FIG. 1, at the end of power section 44 is a cavity 70 for first, second and third wires 20, 22, 24. Cavity 70 is covered by a protective lid 72 that has three cutout portions 76. Power section 44 also has three cutout portions 82 that can be aligned with the cutout portions 76 of protective lid 72 to form an opening through which first, second and third wires 20, 22, 24, pass. Preferably protective lid 72 , once installed in power section 44, cannot be removed. Furthermore, the opening is somewhat undersized so that it makes a water-tight, "choke" seal against the insulation on first, second and third wires 20, 22, 24.

Figure 2:
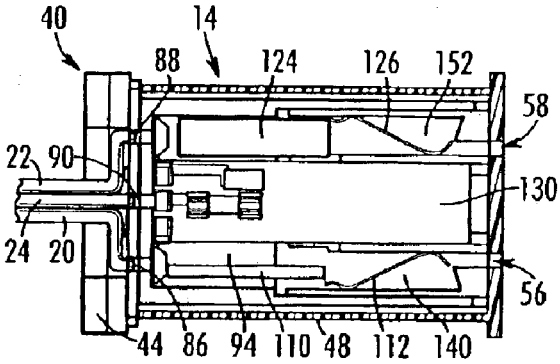
FIG. 2 is a top view of the present receptacle taken along lines 2—2 of FIG. 1, according to a preferred embodiment of the present invention.
Figure 3:
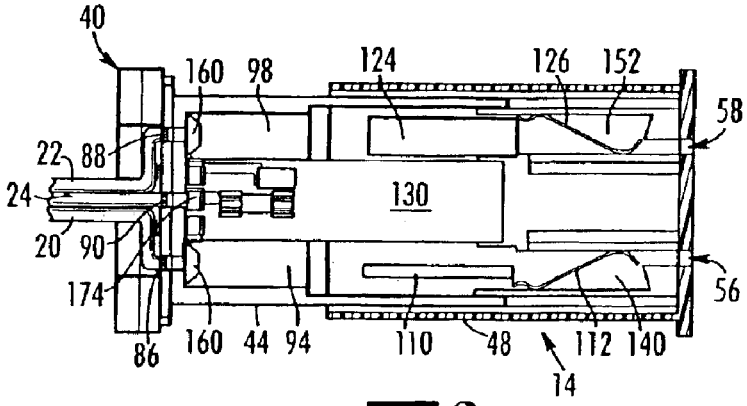
FIG. 3 is a top view of the receptacle of FIG. 2 with the power section and fuse section partially separated.
Figure 4:
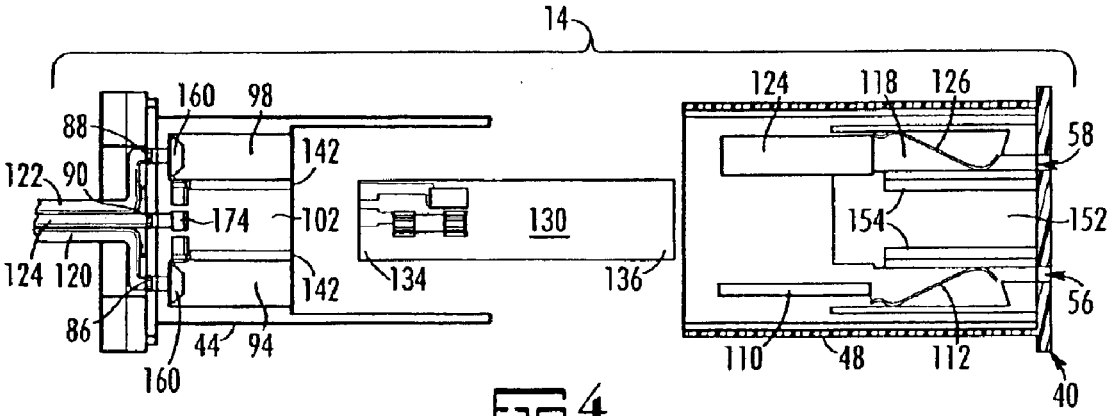
FIG. 4 is a top view of the receptacle of FIG. 2 with the power section, power circuit board, and fuse section completely separated.
Figure 5:
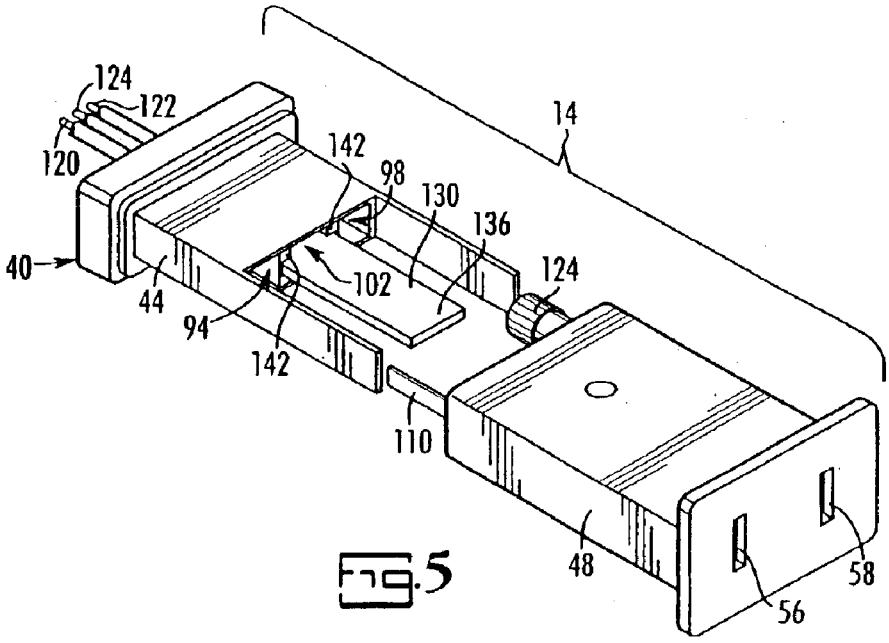
FIG. 5 is a perspective view of the power section and fuse board.
Figure 6:
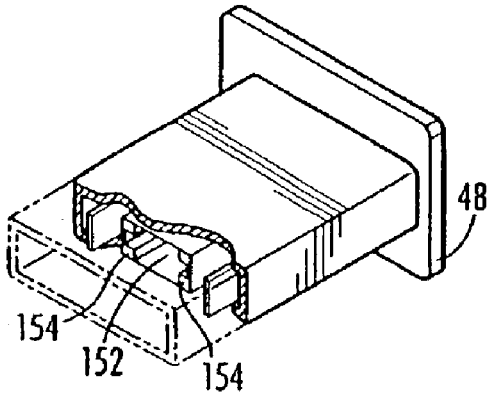
FIG. 6 is a perspective view of the fuse section.
Figure 7:
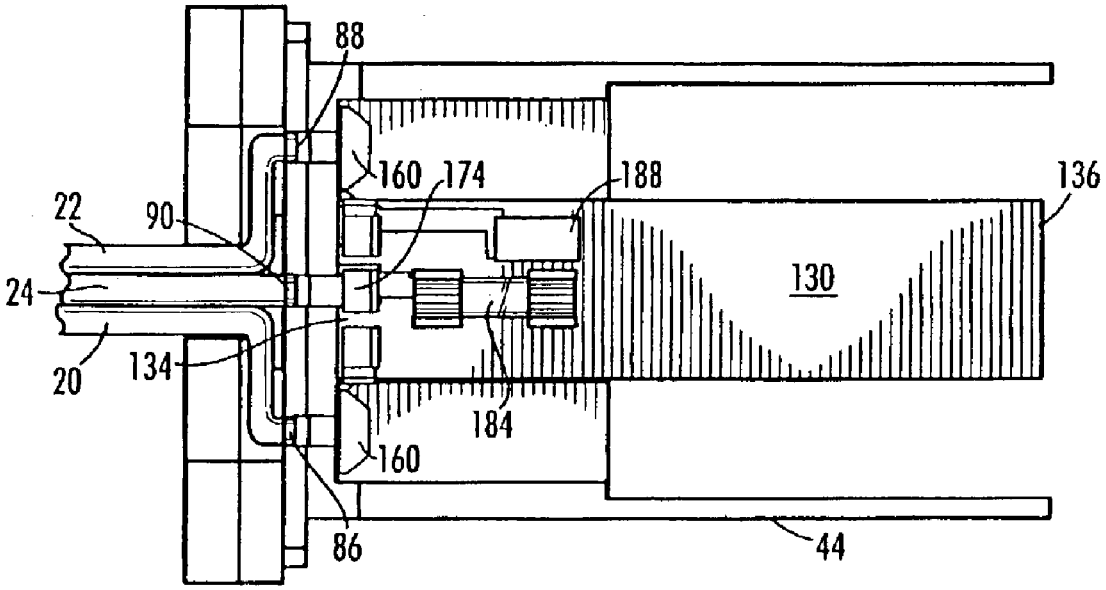
FIG. 7 is a detailed view of the power section and fuse board showing the AC and DC terminals.

FIGS. 2–4 illustrate how power section 44 and fuse section 48 separate and reveal their internal components. FIG. 2 is a cross section of receptacle 14 of FIG. 1, taken along lines 2—2. First, second and third wires 20, 22, 24, are shown entering power section 44, and ending in terminals 86, 88, 90, respectively, that are crimped to the bare, uninsulated ends of these wires and seated near the end of receptacle 14. First and second wires 20, 22, are seated at the bottoms of narrow, deep channels 94, 98. Third wire 24 is seated at the bottom of a thin, deep channel 102 between channels 94 and 98.

In fuse section 48 are three more channels. A first channel 106 contains a buss bar 110 with a spring contact 112 in electrical connection, and preferably also integrally connected, to it. Spring contact 112 is adapted to be resiliently urged to the side but remain engaged with one prong 62 of plug 64 that enters hole 56.

A second channel 118 has a fuse holder 122, holding a fuse 124, and also, connected electrically and preferably integrally, a spring contact 126 that operates in an manner similar to that of spring contact 112. The choice of fuse 124 will help to limit the current passing therethrough in the event of a power surge or demand that exceeds that rating of the circuit.

Note that fuse 124 and buss bar 110 extend beyond fuse section 48 toward power section 44 so that, when fuse section 48 and power section 44 are joined, buss bar 110 and fuse 126 make contact with first and second terminals 86, 88m at the bottoms of channels 94, 98, respectively, and, thus form two electrical paths. The first path runs from first wire 20, through terminal 86 and buss bar 110, to spring contact 112. The second path runs from third wire 24 through terminal 88 and fuse 124, to spring contact 126. These paths can be used to deliver fused AC from plug 10 to an electrical device plugged into receptacle 14.

As power and fuse sections 44, 48, are separated, note that buss bar 110 and fuse 126 remain with fuse section 48 and break contact with terminals 86, 86, respectively. Terminals 86, 88, because they are deep in channels 94, 98, are not likely to cause injury to a user who may be separating the two sections in order to change fuse 126, replace buss bar 110 with a fuse, fuse holder and spring contact, or replace a power control board 130, the function of which will shortly be described.

Power control board 130 is a small circuit board that may hold electrical components and microprocessors selected for particular functions. The choice of components will dictate how board 130 controls power to third wire 24 and, when desired, to first and second wires 20, 22, as well.

A first end 134 of control board 130 is received power section 44 in channel 102 and held in place by four supports 142. Its second end 146 extends from power section 44 when power section 44 has been separated from fuse section 48 but, when they are joined, will be received in a channel 152, located between channels 106 and 118 of fuse section 48, where another four supports 154 help to hold control board 130 in position.

Figure 9:
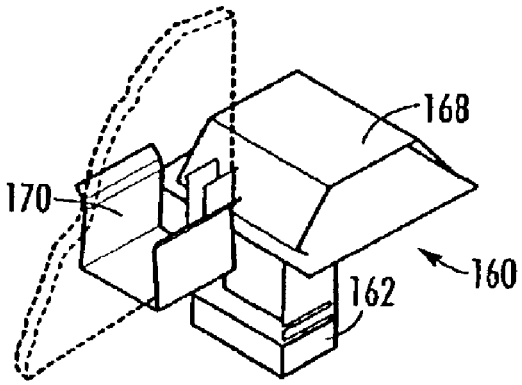
FIG. 9 is a detailed, perspective view of the AC terminal, according to a preferred embodiment of the present invention.

Control board 130 is maintained in electrical connection with first and second terminals 86, 88, using terminal connectors 160 of the type illustrated in FIG. 9. These have a saddle section 162 that engages the end of a wire, a flexing cap 168 to receive the end of a buss bar or fuse, and a board contact 170 for contacting or gripping components on control board 130.

Figure 10:
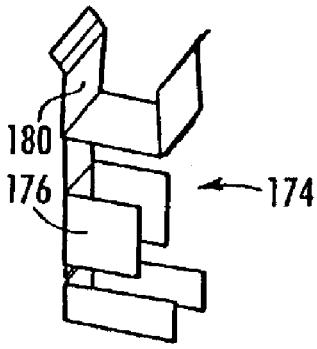
FIG. 10 is a detailed, perspective view of the DC terminal, according to a preferred embodiment of the present invention.
Figure 11:
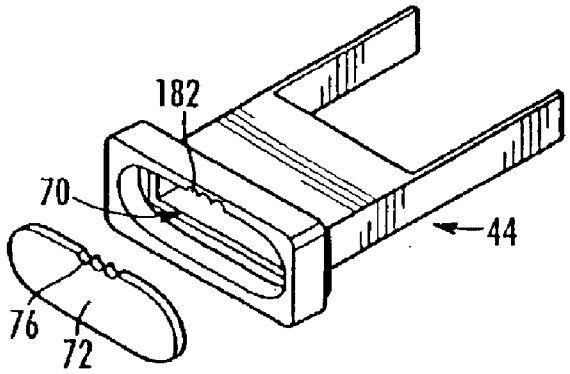
FIG. 11 is a detailed view of the end of the power section showing the protective lid, according to a preferred embodiment of the present invention.

A terminal connector 174 of the type shown in FIG. 10 is used to make electrical connection with third wire 24. Terminal connector 174 has a saddle section 176 and a board contact 180 equivalent to those of terminal connector 160. Preferably, terminal connectors 160, 174, are made of sheet stock that is die cut and folded.

Power control board 130 may have any of the following functions. It may facilitate the delivery of AC or DC power to third wire 24 either with full voltage or stepped down; it may cause that power delivered to third wire 24 to vary in voltage or to pulse or to switch on and off in response to a computer program, in response to sensors, or on command. The commands can be based on a local switch carried by receptacle 14 or a remotely transmitted signal. Power control board 130 may control the voltage across first and second wires 20, 22, as well. Power control board 130 may also monitor the electrical power passing through wires 20, 22, 24.

Figure 8:
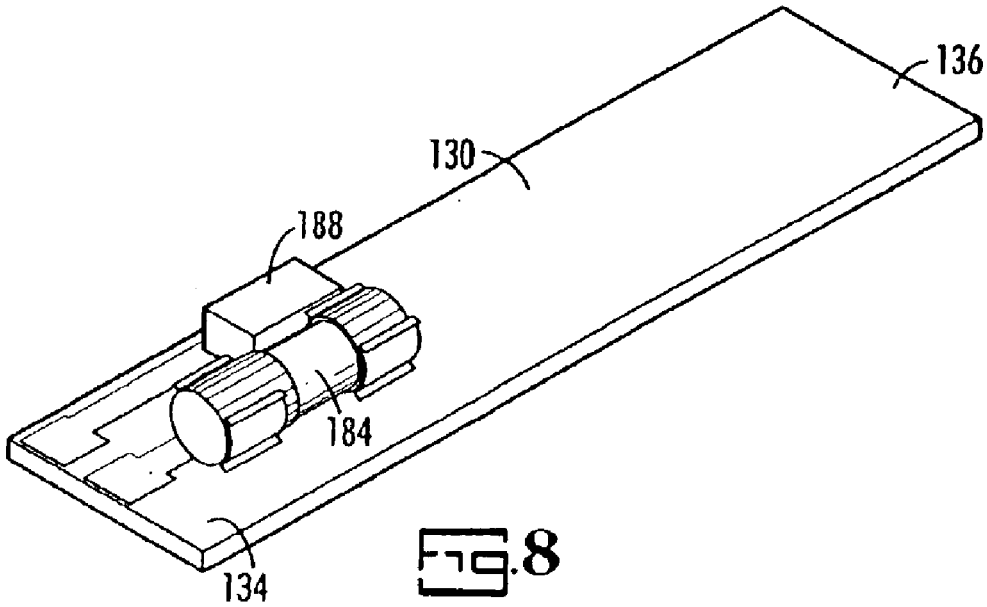
FIG. 8 is a perspective view of the fuse board, according to a preferred embodiment of the present invention.

FIG. 8 illustrates a particular embodiment of components on power control board 130. There is a fuse 184 and a rectifier 188, such as a simple diode that passes current in one direction only, thus rectifying the current being tapped from second wire 22 and passing the rectified current through fuse 184 to the third wire 24 via third terminal 90.

Figure 12:
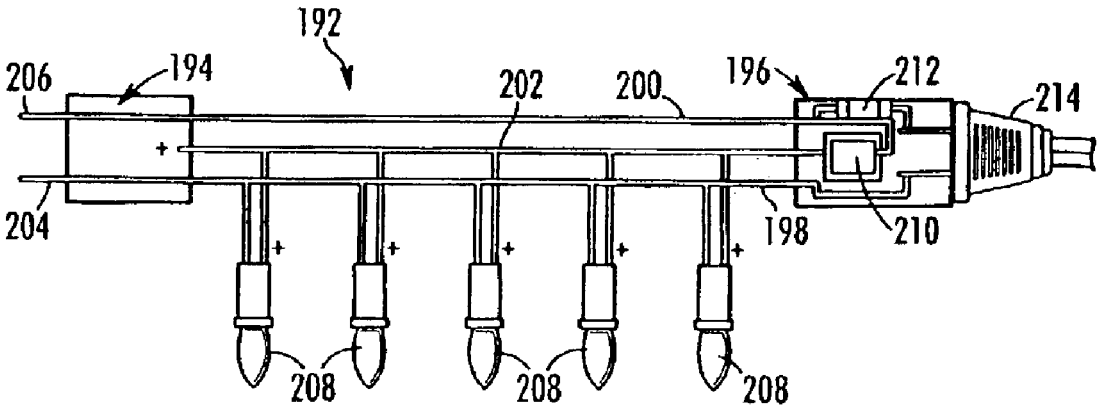
FIG. 12 is a schemative view of an embodiment of the present invention in use as a holiday light string.

An example of the use of power control board 130 is shown in FIG. 12. The device shown in FIG. 12 is a string of holiday lighting 192. String 192 has a plug 194 on one end, a receptacle 196 according to the present invention on the other end and three wires 198, 200, 202 connected to plug 194 and receptacle 196. First and second wires 198, 200, are connected electrically with prongs 204, 206, on plug 194; third wire 202 is not, but merely dead ends in plug 194. A series of small lights 208, such as C7 or C9 bulbs, are connected in parallel to each other across first and third wires 198,202, respectively. Lights 208 operate off fused DC delivered to third wire 202 by a power control board 130 of the kind described above, having a control board 210 that alters the AC delivered to first and second wires 198, 200, to produce DC for third wire 202. Note that full AC is delivered to and can be passed by receptacle 196 via a fuse 212 to another plug 214, such as that on another string of lights.

The load on string 192, namely, the series of lights 208, is separately fused, as could be each of three or more additional strings connected to string. If lights are low watt, efficient bulbs, up to six strings of lights can be strung together operating from power from a single wall receptacle, with low rated, one ampere fuses limiting the current in each string.

It will be apparent to those skilled in the art of electrical appliance power supplies that many modifications and substitutions can be made to the foregoing preferred embodiments without departing from the spirit and scope of the present invention, defined by the appended claims.

What is claimed is:

1. An electrical receptacle for use with an electrical plug, comprising:

a housing having two holes formed therein for receiving prongs of an electrical plug;

a first terminal in said housing;

a second terminal in said housing;

a third terminal in said housing;

a first spring contact in said housing, proximate to a first hole of said two holes and in electrical connection with said first terminal so that, when said prongs of an electrical plug are inserted into said holes, said first spring contact contacts a first prong of said prongs;

a second spring contact in said housing, proximate to a second hole of said two holes and in electrical connection with said second terminal so that, when said prongs of an electrical plug are inserted into said holes, said second spring contact contacts a second prong of said prongs, said first and said second spring contacts supplying electrical current to said prongs of said electrical plug when said first and said second terminals are receiving electrical current and said prongs of said electrical plug are received within said two holes of said housing;

a control board in said housing; and means carried on said control board and in electrical connection with said second terminal and said third terminal for delivering electrical current, when electrical current is supplied to said first and said second terminals, to said third terminal from said second terminal while said first and second terminals deliver electrical current to said first and second spring contacts, respectively.

2. The receptacle as recited in claim 1, wherein said delivering means rectifies said electrical current from said second terminal.

3. The receptacle as recited in claim 1, wherein said delivering means includes a fuse for limiting electrical current to said third terminal.

4. The receptacle as recited in claim 1, wherein said delivering means is removable from said receptacle.

5. The receptacle as recited in claim 1, wherein said delivering means carries components for modifying said electrical current from said second terminal.

6. The receptacle as recited in claim 1, wherein said delivering means is in electrical connection with said first terminal.

7. A device for use with a wall receptacle, comprising:

a plug having two prongs adapted for insertion into a wall receptacle;

a first wire in electrical connection with a first prong of said two prongs of said plug;

a second wire in electrical connection with a second prong of said two prongs of said plug;

a third wire attached to said plug a housing having two holes formed therein for receiving the prongs of an electrical plug;

a first terminal in said housing, said first terminal in electrical connection with said first wire;

a second terminal in said housing, said second terminal in electrical connection with said second wire;

a third terminal in said housing, said third terminal in electrical connection with said third wire;

a first spring contact in said housing, proximate to a first hole of said two holes, and in electrical connection with said first terminal;

a second spring contact in said housing, proximate to a second hole of said two holes, in electrical connection with said second terminal;

a control board in said housing; and means carried on said control board and in electrical connection with said second terminal and said third terminal for delivering electrical current, when electrical current is supplied to said first and said second prongs of said plug, to said third terminal from said second terminal while said first and second terminals deliver electrical current to said first and second spring contacts, respectively, so that, when an electrical plug is inserted in said two holes of said housing, electrical current is delivered to said prongs of said electrical plug by said first and said second spring contacts.

8. The device as recited in claim 7, further comprising an electrical load in electrical connection with said third wire.

9. The device as recited in claim 8, wherein said electrical load is at least one light.

10. The device as recited in claim 8, wherein said delivering means delivers direct current to said electrical load.

11. The device as recited in claim 7, wherein said delivering means rectifies said electrical current from said second terminal and said device further comprises a string of lights in electrical connection with said third wire, said lights receiving rectified electrical current from said third terminal and said third wire.

12. The device as recited in claim 11, wherein said lights are selected from the group consisting of C7 and C9 incandescent lights.

13. The device as recited in claim 11, wherein said delivering means further comprises a fuse for limiting current to said third terminal.

14. The device as recited in claim 7, wherein said delivering means is removable from said receptacle.

15. The device as recited in claim 7, wherein said delivering means carries components for modifying said electrical current from said second terminal.

16. The device as recited in claim 15, wherein said delivering means is in electrical connection with said first terminal.

17. The device as recited in claim 7, wherein said delivering means further comprises a circuit board having electrical components carried therein, and wherein said housing has supports adapted for holding said circuit board, and wherein said circuit board slides onto said supports.

18. The device as recited in claim 7, further comprising terminal contacts for connecting said first terminal, said second terminal and said third terminal to said delivering means.

19. The device as recited in claim 17, wherein said housing has a channel for receiving said circuit board and wherein said device further comprises terminal contacts for electrically connecting said first terminal, said second terminal and said third terminal to said circuit board.

20. The device as recited in claim 19, wherein said electrical components includes a fuse.

* * * * *